United States Patent [19]

Pankove

[11] Patent Number: 4,603,280

[45] Date of Patent: Jul. 29, 1986

[54] ELECTROLUMINESCENT DEVICE EXCITED BY TUNNELLING ELECTRONS

[75] Inventor: Jaques I. Pankove, Princeton, N.J.

[73] Assignee: RCA Corporation, Princeton, N.J.

[21] Appl. No.: 666,341

[22] Filed: Oct. 30, 1984

[51] Int. Cl.[4] ..... H01J 1/62; H01J 63/04; G09G 3/10

[52] U.S. Cl. ..... 313/509; 313/506; 315/169.3

[58] Field of Search ..... 313/509, 506, 169.1; 315/169.3, 167

[56] References Cited

U.S. PATENT DOCUMENTS

| | | | |
|---|---|---|---|
| 3,548,214 | 8/1968 | Brown | 313/509 |
| 4,143,297 | 3/1979 | Fischer | 313/509 |
| 4,326,007 | 4/1982 | Williams et al. | 313/509 |
| 4,369,393 | 1/1983 | Frame | 313/506 |
| 4,416,933 | 11/1983 | Antson et al. | 428/216 |
| 4,418,118 | 11/1983 | Lindors | 313/506 |
| 4,442,136 | 4/1984 | Johnson | 427/53.1 |
| 4,464,602 | 8/1984 | Murphy | 313/509 |

*Primary Examiner*—Leo H. Boudreau
*Assistant Examiner*—M. Razavi
*Attorney, Agent, or Firm*—Eugene M. Whitacre; Dennis H. Irlbeck; LeRoy Greenspan

[57] ABSTRACT

An electroluminescent device comprising a composite structure including first and second electrodes, first and second electroluminescent layers between said electrodes, and an electrically-insulating layer between and contacting both of the electroluminescent layers, said electrically-insulating layer having a substantially-uniform thickness in a range that permits substantial tunnelling of electrons therethrough when as little as 10 to 30 volts are applied across said electrodes.

10 Claims, 3 Drawing Figures

ELECTROLUMINESCENT DEVICE EXCITED BY TUNNELLING ELECTRONS

This invention relates to an electroluminescent device comprising two electroluminescent layers which are excited by tunnelling electrons.

BACKGROUND OF THE INVENTION

U.S. Pat. No. 4,464,602 issued Aug. 7, 1984 to Joseph Murphy discloses and claims an electroluminescent device comprising an electrically-insulating layer of $Y_2O_3$ sandwiched between two electroluminescent layers of manganese-cation-activated zinc sulfide, which composite structure is sandwiched between two electrodes. The electrically-insulating layer is about 4,000 Å thick. The device will emit light when about 70 to 200 volts at about 500 hertz are applied to the device.

SUMMARY OF THE INVENTION

By a simple, but nonobvious modification, the novel device is provided which can emit more light with lower applied voltages and less consumption of power than the prior device. In the novel device, the electrically-insulating layer has a substantially-smaller thickness in a range that permits tunnelling of electrons therethrough when as little as 10 to 30 volts at 50 to 10,000 hertz are applied to the electrodes. For layers of $Y_2O_3$ and most other insulators, the layer thicknesses are in the range of 100 to 300 Å. Electrons which tunnel through the thinner insulating layer in the novel device emerge with substantially more energy for inducing luminescence than electrons that are conducted through the thicker insulating layer of the prior device.

DETAILED DESCRIPTION OF THE PREFERRED EMBODIMENT

Figure 1:
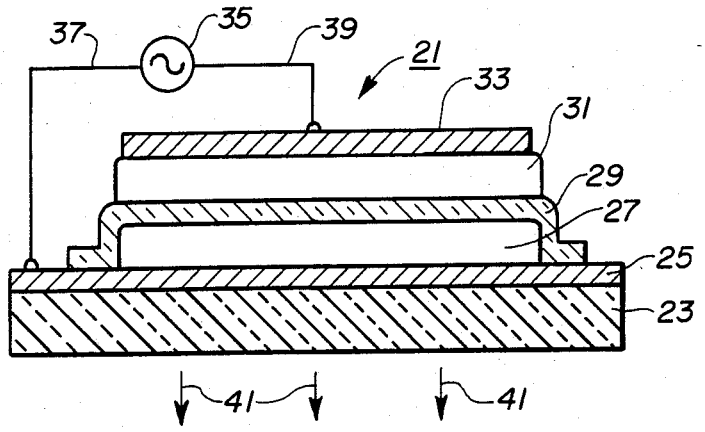
FIG. 1 is a sectional elevational view of a preferred embodiment of the novel device.

FIG. 1 is an electroluminescent device 21 comprising a glass plate 23, with a transparent first electrically-conducting layer 25 of tin oxide on one surface of the glass plate 23. A first EL (electroluminescent) layer 27 of manganese-cation-activated zinc sulfide (ZnS:Mn) about 2,000 Å thick resides on the first conducting layer 25. An electrically-insulating layer 29 of yttrium oxide ($Y_2O_3$) about 200 Å thick resides on the first EL layer 27. A second EL layer 31 of manganese-cation-activated zinc sulfide about 2,000 Å thick resides on the insulating layer 29, and a second electrically-conducting layer 33 of aluminum metal resides on the second EL layer 31.

A source of alternating voltage 35 is connected to the first and second electrically-conducting layers 25 and 33, which serve as electrodes, through leads 37 and 39. When an alternating voltage of 500 hertz above a threshold voltage of about 17 volts up to about 35 volts is applied, the first and second EL layers 27 and 31 emit light in a spectral band of wavelengths around about 5,700 Å, which light is transmitted through the glass plate 23 as indicated by the arrows 41. Electroluminescence is observed near both surfaces of the insulating layer 29.

Figure 2:
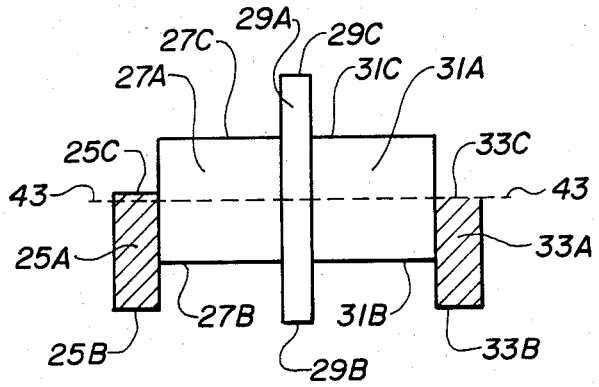
FIG. 2 is a representation of the electronic band structure of the novel device with zero voltage applied.
Figure 3:
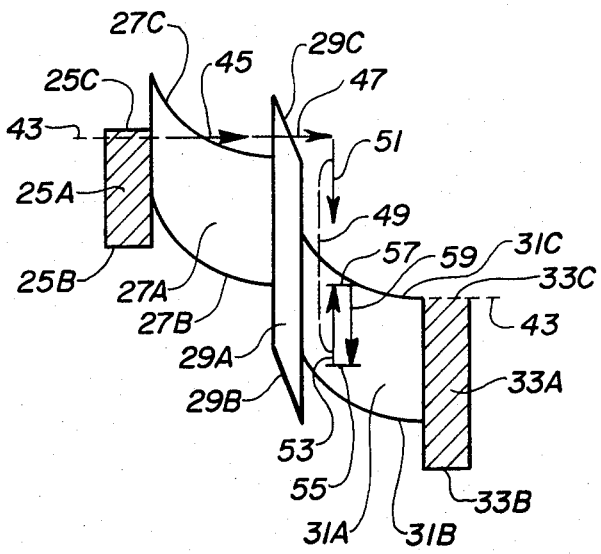
FIG. 3 is a representation of the electronic band structure of the novel device with sufficient voltage applied to induce electroluminescent emission.

The EL emission 41 can be explained by reference to the energy band diagrams in FIGS. 2 and 3. The energy band gaps for each of the layers 25, 27, 29, and 31 are shown by the rectangular areas 25A, 27A, 29A, and 31A respectively. The bottoms 25B, 27B, 29B, and 31B respectively of the rectangles represent the tops of the valence bands, while the tops 25C, 27C, 29C, and 31C respectively of the rectangles represent the bottoms of the conduction bands. The metal layer 33 is represented by the rectangle 33A.

With no voltage applied, the average free electron energy levels (Fermi levels) line up as indicated by the dotted line 43. When more than a peak threshold of alternating voltage is applied, current flow alternates in direction with each half cycle. FIG. 3 shows the energy bands during one half of the cycle when more than a threshold voltage is applied and the first conducting layer 25 is negative and the second conducting layer 33 is positive. During that period, electrons pass relatively freely from the first conducting layer 25 into the first EL layer 27 with no EL emission, as indicated by the arrow 45. Then the electrons tunnel through the insulating layer 29, as indicated by the arrow 47, becoming very energetic as they enter the second EL layer 31, where EL emission is induced. Emission is induced by impact excitation of a luminescent center by an energy exchange interaction indicated by the bracket 49 coupling the arrows 51 and 53, thereby raising an electron from a ground state 55 to an excited state 57. The electron excited by the interaction then spontaneously returns to its ground state 55 emitting a photon as indicated by the arrow 59. On the next half cycle, the positions of the energy bands are reversed, with energetic electrons being generated by tunnelling in the opposite direction, inducing EL emission in the first EL layer 27.

An essential feature of the novel device is the electrically-insulating layer 29, which must have a substantially-uniform thickness in a range that permits substantial tunnelling of electrons therethrough when as little as 10 to 30 volts are applied across the electrodes of the device. For layers of most materials, such as yttrium oxide $Y_2O_3$, alumina $Al_2O_3$, silica $SiO_2$, silicon nitride $Si_3N_4$, barium titanate $BaTiO_3$ and tantalum oxide $TaO_2$, the tunnellable thickness is in the range of 100 to 300 Å. The insulating layer should be free of pinholes and may comprise one or more layers of one or more different insulating materials.

The EL layers 27 and 31 may be of any EL phosphor composition, zinc sulfide activated with 2 weight percent of manganese cations being exemplary. The EL layers 27 and 31 may be of the same or different compositions and the same or different thicknesses. The thicknesses of the EL layers may be in the range of about 200 to 3,000 Å. Because of the alternating electrical character of the operation of the novel device, it is preferred that the device be symmetrical in its electrical characteristics. The EL layers 27 and 31 may be resistive but should have sufficient conductivity so that most of the applied voltage appears across the electrically-insulating layer 29 of the device.

The electrodes may be areal as shown in FIG. 1 and of any chemical and physical constitution usable for EL devices. The electrodes may also be orthogonal arrays of stripes designed for inducing EL emission from limited predetermined areas of the EL layers 27 and 31.

In view of the many possible embodiments of the novel device, the applied peak alternating voltage may be in the range of about 10 to 100 volts with a threshold voltage of about 10 to 30 volts, using frequencies in the range of 50 to 10,000 hertz.

The novel devices are preferably prepared by multiple successive depositions of the desired materials by condensation in a vacuum, which materials may be evaporated from an electron-beam heated evaporator upon a glass plate that already has a conducting layer thereon. Of course, other methods of deposition in a vacuum may be used. Also, chemical vapor deposition may be used.

An advantage of the novel structure is that electrons enter the EL phosphor layers with high kinetic energy, resulting in higher electroluminescence efficiency than if they were accelerated within the phosphor only (the usual case). Another advantage is that only one electrically-insulating layer (the most critical layer in the structure) is needed. Furthermore, a low threshold voltage is obtained with conducting layers outside the EL phosphor layers.

What is claimed is:

1. An electroluminescent device comprising a composite structure including first and second electrode layers, first and second electroluminescent layers between said electrode layers, and an electrically-insulating layer between and contacting both of said electroluminescent layers, said electrically-insulating layer having a substantially-uniform thickness in a range of up to 300 Å and permits substantial tunnelling of electrons therethrough when as little as 10 to 30 volts are applied across said electrode layers.

2. The device defined in claim 1 wherein the thickness of said electrically-insulating layer is in the range of about 100 to 300 Å.

3. The device defined in claim 2 wherein said electrically-insulating layer consists essentially of at least one member of the group consisting of $Y_2O_3$, $Si_3N_4$, $SiO_2$, $Al_2O_3$, $BaTiO_3$, and $TaO_2$.

4. The device defined in claim 2 wherein said electrically-insulating layer consists essentially of $Y_2O_3$.

5. The device defined in claim 1 wherein the thicknesses of said electroluminescent layers are in the range of about 200 to 3,000 Å.

6. The device defined in claim 5 wherein said electroluminescent layers have substantially identical compositions and thicknesses.

7. The device defined in claim 5 wherein said electroluminescent layers consist essentially of binder-free layers of inorganic metal-ion-activated host material.

8. The device defined in claim 5 wherein said electroluminescent layers consist essentially of zinc sulfide host material activated with manganese cations.

9. The device defined in claim 1 including means for applying across said electrodes voltages in the range of 10 to 100 volts at frequencies in the range of 50 to 10,000 hertz.

10. The device defined in claim 4 including means for applying across said electrodes voltages in the range of 10 to 60 volts at frequencies in the range of 50 to 10,000 hertz.

* * * * *